US007998919B2

(12) United States Patent
Rong et al.

(10) Patent No.: US 7,998,919 B2
(45) Date of Patent: Aug. 16, 2011

(54) COMPOSITIONS FOR TREATING HARD SURFACES COMPRISING SILYL POLYALKOXYLATES

(75) Inventors: Haitao Rong, Darmstadt (DE); Stefan Stumpe, Düsseldorf (DE); Matthias Lüken, Düsseldorf (DE); Mirko Weide, Düsseldorf (DE); Jürgen Groll, Aachen (DE); Peter Greiwe, Heidelberg (DE)

(73) Assignee: Henkel AG & Co. KGaA (DE)

( * ) Notice: Subject to any disclaimer, the term of this patent is extended or adjusted under 35 U.S.C. 154(b) by 108 days.

(21) Appl. No.: 12/517,374

(22) PCT Filed: Dec. 4, 2007

(86) PCT No.: PCT/EP2007/063204

§ 371 (c)(1),
(2), (4) Date: Jun. 3, 2009

(87) PCT Pub. No.: WO2008/068236

PCT Pub. Date: Jun. 12, 2008

(65) Prior Publication Data

US 2010/0056415 A1 Mar. 4, 2010

(30) Foreign Application Priority Data

Dec. 5, 2006 (DE) ..... 10 2006 057 632
Aug. 22, 2007 (DE) ..... 10 2007 039 652

(51) Int. Cl.
*C11D 9/36* (2006.01)

(52) U.S. Cl. ..... 510/466; 510/221; 510/228; 510/235; 510/238; 510/245; 510/364; 510/365; 510/425; 510/426; 510/427; 510/428

(58) Field of Classification Search ..... 510/221, 510/228, 235, 238, 245, 364, 365, 425, 426, 510/427, 428, 466
See application file for complete search history.

(56) References Cited

U.S. PATENT DOCUMENTS

| | | | | |
|---|---|---|---|---|
| 4,749,515 | A * | 6/1988 | Miyamoto et al. | 510/414 |
| 5,254,284 | A * | 10/1993 | Barone et al. | 510/181 |
| 5,475,127 | A | 12/1995 | Klein et al. | |
| 6,004,545 | A * | 12/1999 | Karlen et al. | 424/70.12 |
| 6,090,765 | A * | 7/2000 | Black et al. | 510/238 |
| 6,117,830 | A * | 9/2000 | Yokosuka et al. | 510/242 |
| 6,150,311 | A * | 11/2000 | Decoster et al. | 510/122 |
| 6,255,434 | B1 | 7/2001 | McGraw et al. | |
| 6,352,582 | B1 * | 3/2002 | Brown | 106/3 |
| 6,423,661 | B1 | 7/2002 | McGraw et al. | |
| 6,528,070 | B1 * | 3/2003 | Bratescu et al. | 424/401 |
| 7,186,675 | B2 | 3/2007 | Meine et al. | |
| 2002/0064510 | A1 * | 5/2002 | Dalrymple et al. | 424/70.22 |
| 2002/0193270 | A1 * | 12/2002 | Cermenati et al. | 510/302 |
| 2003/0153712 | A1 | 8/2003 | Ludewig et al. | |
| 2004/0033924 | A1 * | 2/2004 | Murphy et al. | 510/421 |
| 2004/0096507 | A1 | 5/2004 | Kwang et al. | |
| 2005/0233925 | A1 * | 10/2005 | Foley et al. | 510/197 |
| 2006/0104937 | A1 * | 5/2006 | Bailey et al. | 424/70.22 |
| 2007/0128143 | A1 * | 6/2007 | Gruning et al. | 424/70.12 |
| 2007/0277697 | A1 * | 12/2007 | Diamond et al. | 106/3 |
| 2010/0119705 | A1 * | 5/2010 | Roche et al. | 427/164 |

FOREIGN PATENT DOCUMENTS

| | | | |
|---|---|---|---|
| DE | 10357232 | B3 | 6/2005 |
| EP | 0679653 | A1 | 11/1995 |
| EP | 1245667 | A1 | 10/2002 |
| WO | WO-96/18717 | A1 | 6/1996 |
| WO | WO-97/00609 | A1 | 1/1997 |
| WO | WO-02/22770 | A1 | 3/2002 |
| WO | WO-2006/005358 | A1 | 1/2006 |

* cited by examiner

*Primary Examiner* — Charles I Boyer
(74) *Attorney, Agent, or Firm* — Connolly Bove Lodge & Hutz LLP

(57) ABSTRACT

The invention relates to compositions for treating a hard surface, in particular for cleaning and/or dirt-repellent treatment of a hard surface, containing a) at least one multi-armed silyl polyalkoxylate of the formula (I) $(H\text{-}A)_n\text{-}Z\text{-}[A\text{-}B\text{—}Si(OR^1)_r(R^2)_{3-r}]_m$ (I), where Z is a (m+n)=valent radical having at least three carbon atoms, A is a divalent polyoxyalkylene radical, wherein the m+n polyoxyalkylene radicals bound to Z can be different from one another, and wherein one radical A is in each case bound to Z via an oxygen atom belonging to Z, and one oxygen atom belonging to A is bound to B or hydrogen, B is a chemical bond or a divalent organic radical having 1 to 50 carbon atoms, $OR^1$ is a hydrolysable group, $R^1$ and $R^2$ independently of one another are a linear or branched alkyl group having 1 to 6 carbon atoms and r is an integer from 1 to 3, and m is an integer ≧1 and n is 0 or an integer ≧1, and m+n has a value from 3 to 100, b) at least one surfactant, c) water and/or at least one nonaqueous solvent, d) if appropriate further conventional components of surface treatment and/or cleaning compositions which are compatible with the remaining components of the composition.

18 Claims, No Drawings

COMPOSITIONS FOR TREATING HARD SURFACES COMPRISING SILYL POLYALKOXYLATES

RELATED APPLICATIONS

This application is a national stage application under 35 U.S.C. §371 of PCT/EP2007/063204, filed Dec. 4, 2007, which claims benefit of German application 102006057632.2, filed Dec. 5, 2006, and German application 102007039649.1, filed Aug. 22, 2007.

The present invention relates to the technical field of treatment agents for hard surfaces, in particular cleaning agents for hard surfaces and agents which protect surfaces from soiling and/or facilitate the detachment of soiling from the surface.

In both the household and commercial fields, there are many different types of hard surfaces which are exposed to the effects of the most varied kinds of dirt. The surfaces of wall and floor tiles, glazing, kitchen appliances and ceramic sanitary ware may be mentioned purely by way of example. Agents containing surfactants have long been used for cleaning such surfaces, the cleaning action of which agents is primarily determined by the ability of surfactants to solubilize dirt particles, so making it possible to detach them or rinse them off from the surface. However, depending on the nature of the surface and nature of the dirt, the dirt can adhere remarkably strongly to the surface. This is all the more the case if the soiling remains for an extended period of time on the surface and the adhesion is so further strengthened by ageing processes. As a result, the dirt may become very difficult to remove and thus cause major difficulty with cleaning. The search has therefore intensified in recent times for agents which not only improve the cleaning power of cleaning agents but which prevent or at least delay the soiling of surfaces which are already in use.

Methods have accordingly been developed for various hard materials by means of which these materials may be provided with a dirt-repellent finish during their production. However, such permanent finishes can only be produced by complicated methods and are generally only available for new materials which are finished in this way by the original manufacturer.

In addition, however, agents have also been found with which surfaces may subsequently be finished in a manner which can be carried out domestically such that, at least for a certain service life, they are less easily soiled or may be cleaned more easily.

Facilitating and improving cleaning and preventing renewed soiling are of particular practical interest in the area of ceramic sanitary ware. Cleaning flush toilets above all involves removing lime and urine scale and fecal residues adhering to the ceramics. Conventional WC cleaning agents are frequently made acidic, for example by addition of organic acids such as citric acid or sulfamic acid, to ensure a high level of effectiveness against lime and urine scale. Cleaning performance against fecal soiling is generally also good, but mechanical force must be applied, thus with the assistance of a toilet brush, to the surface of the WC. This mechanical effort is greater in the case of older, already dried on soiling, with even moist fecal soiling being capable of adhering tenaciously to ceramic materials.

Patent application WO 2006/005358 discloses copolymers which consist of at least one of each of an anionic vinyl monomer, a vinyl monomer with a quaternary ammonium group or a tertiary amino group, and a nonionic hydrophilic vinyl monomer or a polyfunctional vinyl monomer. These copolymers are suitable as soil-inhibiting components in cleaning agents and are effective, for example, against fecal soiling.

However, even using these cleaners, longer lasting cleanness, which extends beyond one-off use, of the toilet interior relative to renewed fecal soiling cannot be achieved in completely satisfactory manner.

A further problem may also arise from the fact that, to enhance dissolution of lime, toilet cleaning agents are not uncommonly left to act on the ceramics for an extended period of time, often for several hours or even overnight. In order to promote adhesion to the ceramics, the formulations are generally thickened. In the event of an extended period of action, a film then forms on the surface which, due to the product color, is usually colored and, once having dried on, can only be removed with difficulty.

Hard surfaces which are repeatedly exposed to the action of moisture are frequently colonized by microorganisms resulting in the formation of biofilms. Biofilms consist of a mucilaginous layer (film) in which microorganisms (for example bacteria, algae, fungi, protozoa) are embedded. This may constitute a problem of not only a hygienic but also an esthetic nature. Biocidal substances are frequently used as countermeasures. However, this is not always without its own problems due to the ecotoxicological properties of many of these substances and the associated restrictions on their use. Moreover, biofilms contribute to the formation of unpleasant smelling substances and are therefore a source of unwanted malodors, in particular in sanitary applications.

Agents for treating hard surfaces must furthermore satisfy other requirements. For instance, it is important for the appearance of the surface not to be impaired after it has been treated. Factors which are in particular of importance here are the retention of gloss on surfaces which in the original or clean state are glossy and the avoidance of residues of the treatment agent, for example in the form of lines or streaks.

Finally, there is a requirement for methods and agents for providing a dirt-repellent finish on a hard surface and/or for facilitating the detachment of dirt and/or for reducing the formation or adhesion of biofilms, it being possible to achieve these effects either in an independent surface treatment method or alternatively in the course of a cleaning method in which a surface is cleaned and simultaneously provided with the above-stated properties.

In producing such agents, it is furthermore necessary for the ingredients used to be straightforwardly incorporable into the formulation and for the agents to exhibit good storage stability.

U.S. Pat. No. 6,423,661 B1 describes silyl-terminated prepolymers which are produced by reacting the OH groups of a polyether polyol, which may comprise up to eight arms, with an isocyanatosilane. The resultant compounds, described as prepolymers, are for use in adhesives. Use of the prepolymers in surface treatment or cleaning agents is not disclosed.

US 2003/0153712 A1 discloses a polyurethane prepolymer with terminal alkoxysilane and hydroxy groups. Production is carried out by reacting a polyether diol firstly with a substoichiometric quantity of diisocyanate and the resultant isocyanate/hydroxy compound is then further treated with an aminosilane to introduce the silyl groups. The described prepolymers, which are di-armed polyalkoxylates, are used to produce sealants and adhesives.

US 2004/0096507 A1 relates to hexa-armed polyethylene glycol derivatives and discloses a completely silyl-terminated derivative which can be produced from sorbitol as the central unit. The polyethylene glycol derivatives described in the document are intended to be suitable for producing biodegradable polymeric hydrogels and for medical/pharmaceutical use, for example for implants.

The object of the invention was accordingly to remedy at least in part the above-stated disadvantages of the prior art. In particular, the object was to provide agents for improving the removability of dirt and biofilms from hard surfaces, in particular WC ceramics, and to prevent such soiling from reforming on such surfaces.

It has now been found that agents containing certain silyl polyalkoxylates are particularly suitable for protecting a surface treated therewith from soiling and/or for facilitating the detachment of soiling from the surface.

The present invention accordingly provides an agent for treating a hard surface, in particular for cleaning and/or for providing a dirt-repellent treatment of a hard surface, containing a) at least one multi-armed silyl polyalkoxylate of the formula (I)

$$(H\text{-}A)_n\text{-}Z\text{-}[A\text{-}B\text{—}Si(OR^1)_r(R^2)_{3-r}]_m \quad (I)$$

in which

Z denotes an (m+n)-valent residue with at least three carbon atoms, A means a divalent polyoxyalkylene residue, the m+n polyoxyalkylene residues attached to Z possibly being different from one another and a residue A in each case being joined to Z via an oxygen atom belonging to Z and an oxygen atom belonging to A being joined to B or hydrogen, B denotes a chemical bond or a divalent organic residue with 1 to 50 carbon atoms, $OR^1$ means a hydrolyzable group, $R^1$ and $R^2$ mutually independently mean a linear or branched alkyl group with 1 to 6 carbon atoms and r denotes an integer from 1 to 3, and m is an integer ≧1 and n denotes 0 or an integer ≧1, and m+n has a value of 3 to 100, b) at least one surfactant, c) water and/or at least one nonaqueous solvent d) optionally further conventional ingredients of surface treatment and/or cleaning agents which are compatible with the other constituents of the agent.

For the purposes of the present invention, hard surfaces in particular comprise surfaces of stone or ceramic materials, rigid plastics materials, glass or metal. Hard surfaces may be, for example, walls, work surfaces, flooring or sanitary articles. In particular, the invention relates to surfaces of ceramics, preferably ceramic sanitary ware, and very particularly of toilet bowls.

Methods suitable for treating a surface are any conventional methods with which the agent may be applied onto the surface. For the particularly preferred case in which the agent is liquid at room temperature, the surface is preferably treated by the agent being transferred onto the surface with the assistance of an absorbent fabric or by the agent being sprayed onto the surface. However, treatment may, for example, also proceed by immersing the surface in the agent.

For the purposes of the invention, dirt or soiling should in particular be taken to mean fecal soiling and/or biofilms.

Treating a hard surface with the agent according to the invention protects it from soiling and/or facilitates the detachment of soiling from the surface. In particular, without exhibiting a biocidal action, the agent prevents the formation of biofilms. It is suspected that the efficacy of the agents used according to the invention against the formation of biofilms is attributable to a bacteriostatic action of the silyl polyalkoxylates used, whereby colonization of the surfaces with microorganisms is inhibited and their adhesion and multiplication on the surfaces is prevented. On the other hand, since no biocidal effects have been observed for the agents, they do not suffer from the above-mentioned disadvantages of using biocides.

The agents according to the invention bring about easier removability of soiling and a reduction in susceptibility to resoiling and in particular improve the cleaning performance of cleaning agents for hard surfaces. As a result, surfaces treated or cleaned accordingly are perceived to be clean for longer.

It has further been observed that not only easier and more rapid removal of fecal soiling but also improved rinsing away of the dried on (optionally colored) cleaning agent itself is possible if a silyl polyalkoxylate of the formula (I) is added to the cleaning agent formulation. If fecal soiling occurs on a surface treated in this manner, the dirt can be removed without appreciable mechanical force the next time the toilet is flushed. In general, this is achieved solely by the mechanical action of the flushing water, without requiring any additional assistance from a toilet brush. If colored cleaning formulations are left to act on the surface for an extended period and the formulation dries on to some extent, the resultant colored film is nevertheless easily and completely removed the next time the toilet is flushed.

The use of silyl polyalkoxylates of the formula (I) as an additive in surfactant-containing cleaning agents makes it possible in a single step not only to clean a surface, but also simultaneously to provide it with protection from dirt. In this manner, lime deposition, adhesion of dirt containing protein or fat and also bacterial growth are, for example, prevented. The treated surfaces stay clean longer and subsequent cleaning is furthermore considerably facilitated. This means that, without any negative impact on cleanness, the surfaces need be cleaned less often, and subsequent cleaning thereof is associated with less effort in that it can proceed more quickly and/or requires gentler cleaning agents. In favorable cases, it is thus possible to achieve an adequate cleaning action for a certain time just with water, i.e. without requiring the use of a conventional cleaning agent.

The silyl polyalkoxylates of the formula (I) may straightforwardly and simply be formulated together with the other constituents of the agent and may in particular also very simply be incorporated into conventional cleaning agent formulations. In particular, the advantageous solubility characteristics of these substances mean that incorporating them into conventional cleaning agents does not result in any limitations, such as for instance impaired sprayability.

Multi-armed silyl polyalkoxylates for the purposes of the present invention contain polymer arms which are attached substantially in a stellate arrangement or radially to a central unit.

In a preferred embodiment of the invention, a silyl polyalkoxylate of the formula (I) or a mixture of two or more of these compounds is used, the mass-average (weight-average) molecular weight amounting to 500 to 50000, preferably 1000 to 20000, and particularly preferably 2000 to 10000. The silyl polyalkoxylate here preferably contains 0.3 to 10 wt. %, particularly preferably 0.6 to 5 wt. % silicon, relative to the total weight of the silyl polyalkoxylate.

Z preferably denotes an at least trivalent, in particular tri- to octavalent, acyclic or cyclic hydrocarbon residue with 3 to 12 carbon atoms, it being possible for the residue to be saturated or unsaturated and in particular also aromatic. Z particularly preferably denotes the trivalent residue of glycerol or the tri- to octavalent residue of a sugar, for example the hexavalent residue of sorbitol or the octavalent residue of sucrose. The x-valent residue of one of the above-stated polyols should here be taken to mean the molecular fragment of the polyol which remains after removal of the hydrogen atoms from x alcoholic or phenolic hydroxy groups. Z may in principle denote any central unit which is known from the literature for producing stellate (pre)polymers.

It is furthermore particularly preferred in the formula (I) for n to denote 0, 1 or 2 and for m to mean a number from 3 to 8.

A preferably denotes groups selected from poly-$C_2$-$C_4$-alkylene oxides, particularly preferably a (co)polymer of ethylene oxide and/or propylene oxide, in particular a copolymer with a proportion of propylene oxide of up to 60 wt. %, preferably of up to 30 wt. % and particularly preferably of up to 20 wt. %, it being possible for the polymers to be random and/or block copolymers. Accordingly, in a further preferred embodiment of the invention, A in the formula (I) denotes $—(CHR^{3-}CHR^{4-}O)_p—$, $R^3$ and $R^4$ mutually independently meaning hydrogen, methyl or ethyl and p meaning an integer from 2 to 10000.

B in particular denotes a chemical bond or a divalent, low molecular weight organic residue with preferably 1 to 50, in particular 2 to 20 carbon atoms. Examples of divalent low molecular weight organic residues are short-chain aliphatic and heteroaliphatic residues such as for example $—(CH_2)_2—$, $—(CH_2)_3—$, —C(O)—NH—$(CH_2)_3$— and —C(O)—NH—X—NH—C(O)—NH—$(CH_2)_3$—, X denoting a divalent aromatic residue such as the phenylene residue or an alkylidene residue. B very particularly preferably denotes a bond or the residue —C(O)—NH—$(CH_2)_3$—.

$R^1$ and $R^2$ preferably mutually independently denote methyl or ethyl, and r denotes 2 or 3. Examples of residues $—Si(OR^1)_r(R^2)_{3-r}$ are dimethylethoxysilyl, dimethylmethoxysilyl, diisopropylethoxysilyl, methyldimethoxysilyl, methyldiethoxysilyl, trimethoxysilyl, triethoxysilyl or tri-t-butoxysilyl residues, but trimethoxysilyl triethoxysilyl residues are very particularly preferred.

It is very particularly preferred for $R^1$ and $R^2$ to be identical and to denote methyl or ethyl. It is furthermore particularly preferred for r to denote the number 3.

The total of m+n preferably amounts to 3 to 50, in particular 3 to 10 and particularly preferably 3 to 8, and matches the number of arms which are attached to the central unit Z in the compound (I). The central unit therefore preferably has 3 to 50, in particular 3 to 10 and particularly preferably 3 to 8 oxygen atoms which serve as connection points for the arms.

In one particular embodiment, n is equal to 0. In the event that n is >0, the ratio n/m is between 99/1 and 1/99, preferably 49/1 and 1/49, and in particular 9/1 and 1/9.

In a further preferred embodiment of the invention, the agent contains a mixture of at least two, in particular two to four different multi-armed silyl polyalkoxylates of the formula (I).

It is particularly preferred here for the at least two different multi-armed silyl polyalkoxylates to differ in their number of arms. A first silyl polyalkoxylate with 3 to 6 arms is here advantageously combined with a second silyl polyalkoxylate with 6 to 10 arms.

Particularly preferred mixtures are those comprising at least two different multi-armed silyl polyalkoxylates of the formula (I) with n=0, which are selected from the group of multi-armed silyl polyalkoxylates of the formula (I) with m=3, m=6 and m=8.

If two different multi-armed silyl polyalkoxylates are used, they are generally present in a quantity ratio of 99:1 to 1:99, preferably of 49:1 to 1:49, and in particular of 9:1 to 1:9.

In a further particularly preferred embodiment of the invention, the agent according to the invention furthermore contains at least one hydrolyzable silicic acid derivative.

Hydrolyzable silicic acid derivatives should in particular be taken to mean the esters of orthosilicic acid, in particular tetraalkoxysilanes and very particularly preferably tetraethoxysilane. For the purposes of the present invention, hydrolyzable silicic acid derivatives should, however, also be taken to mean compounds which, in addition to three alkoxy groups, also bear a carbon residue on the silicon atom, such as for example N-(triethoxysilyipropyl)-O-polyethylene oxide urethane, dimethyloctadecyl-(3-(trimethoxysilylpropyl)-ammonium chloride, diethylphosphatoethyltriethoxysilane and the trisodium salt of N-(trimethoxysilylpropyl)ethylenediaminetriacetic acid.

In this embodiment, it is particularly advantageous for the quantity ratio of silyl polyalkoxylate or silyl polyalkoxylate mixture to the at least one hydrolyzable silicic acid derivative to amount to 90:10 to 10:90, preferably to 50:50 to 10:90, and in particular to 40:60 to 20:80.

The at least one silyl polyalkoxylate of the formula (I) is conventionally used in the agents according to the invention in a quantity of 0.001 to 20 wt. %, in particular of 0.01 to 10 wt. %, preferably of 0.05 to 5 wt. % and particularly preferably of 0.1 to 1 wt. %, in each case relative to the total weight of the agent.

Where the multi-armed silyl polyalkoxylates of the general formula (I) used according to the invention are not known from the literature, they may be produced by functionalizing suitable multi-armed polyalkoxylate precursors by analogy with known prior art functionalization methods.

The di-armed polyurethane prepolymer with terminal alkoxysilane and hydroxy groups described in US 2003/0153712 A1 is produced by reacting a polyether diol firstly with a substoichiometric quantity of diisocyanate and then further treating the resultant isocyanate/hydroxy compound with an aminosilane to introduce the silyl groups. The synthesis principles applied therein may in principle be transferred to the production of multi-armed polyalkoxylates according to the teaching of the present invention.

U.S. Pat. No. 6,423,661 B1 describes silyl-terminated prepolymers which are produced by reacting the OH groups of a polyether polyol, which may comprise up to eight arms, with an isocyanatosilane. The teaching of this document comprises prepolymers which come within the general formula (I) of the present invention.

US 2004/0096507 A1 relates to hexa-armed polyethylene glycol derivatives and discloses a completely silyl-terminated derivative which can be produced from sorbitol as the central unit and which comes within general formula (I) of the present invention.

Suitable polyalkoxylate precursors for producing the silyl polyalkoxylates used according to the invention are in turn also multi-armed polyalkoxylates which already comprise the above-described multi-armed structure and comprise a hydroxy group on the end of each of the polymer arms, which group(s) may be converted entirely or in part into $—B—Si(OR^1)_r(R^2)_{3-r}$ group(s). The polyalkoxylate precursors of the silyl polyalkoxylates used according to the invention may be represented by the general formula (II)

$$Z\text{-}(A\text{-}OH)_{m+n} \quad (II)$$

Z, A, m and n having the same meaning as previously described for the compounds of the formula (I).

Suitable polyalkoxylate precursors are for example known from the literature under the name stellate or multi-armed polyether polyols. These polyalkoxylate precursors are produced by polymerizing suitable monomers, in particular ethylene oxide and/or propylene oxide, using small polyfunctional molecules such as for example glycerol or sorbitol as initiator. Examples of multi-armed polyether polyols which may be mentioned are ethoxylates or propoxylates of glycerol, sucrose and sorbitol, as are described in U.S. Pat. No. 6,423,661. Due to the random nature of the polymerization reaction, the above-stated details relating to the polymer arms of the silyl polyalkoxylates used according to the invention, in particular with regard to arm length and arm number (m+n), should in each case be regarded as a statistical average.

Some suitable polyalkoxylate precursors are also commercially obtainable. One example of this is Voranol 4053, a polyether polyol (poly(ethylene oxide-co-propylene oxide)) from DOW Chemicals. This is a mixture of two different polyether polyols, consisting of a tri-armed polyether polyol with glycerol as central unit and an octa-armed polyether polyol with cane sugar as central unit. The arms are random copolymers of approx. 75% EO and approx. 25% PO, the OH functionality (hydroxy end groups) amounts on average to 6.9 at a mass-average (weight-average) molecular weight of approx. 12000. This results in a ratio of approx. 78% octa-armed polyether polyol and approx. 22% tri-armed polyether polyol. Another example is Wanol R420 from WANHUA, China, which is a mixture of a linear poly(propylene/ethylene) diethylene glycol and an octa-armed polyether polyol (poly(propyleneoxy/ethyleneoxy)sucrose) in a ratio of approx. 15-25:85-75. Another commercially obtainable polyether polyol is Voranol CP 1421 from DOW Chemicals, which comprises a tri-armed random poly(ethylene oxide-co-propylene oxide) with an EO/PO ratio of approx. 75/25 and a mass-average (weight-average) molecular weight of approx. 5000.

Starting materials which may be considered for converting the hydroxy end groups of the multi-armed polyalkoxylate precursors into the groups —B—$Si(OR^1)_r(R^2)_{3-r}$ are in principle any functional silanes comprising a functional group which is reactive towards the hydroxy end groups of the polyalkoxylate precursor. Examples are tetraalkoxysilanes such as tetramethyl silicate and tetraethyl silicate, (meth) acrylate silanes such as (3-methacryloxypropyl)-trimethoxysilane, (methacryloxymethyl)triethoxysilane, (methacryloxymethyl)-methyldimethoxysilane and (3-acryloxypropyl) trimethoxysilane, isocyanatosilanes such as (3-isocyanatopropyl)trimethoxysilane, (3-isocyanato-propyl)triethoxysilane, (isocyanatomethyl)methyldimethoxysilane and (isocyanatomethyl)trimethoxysilane, aldehyde silanes such as triethoxysilylundecanal and triethoxysilylbutyraldehyde, epoxy silanes such as (3-glycidoxypropyl)trimethoxysilane, anhydride silanes such as 3-(triethoxy-silyl) propylsuccinic anhydride, halosilanes such as chloromethyltrimethoxysilane and 3-chloropropylmethyldimethoxysilane, hydroxysilanes such as hydroxymethyltriethoxysilane, and tetraethyl silicate (TEOS), which are commercially obtainable for example from Wacker Chemie GmbH (Burghausen), Gelest, Inc. (Morrisville, USA) or ABCR GmbH & Co. KG (Karlsruhe) or may be produced using known methods. Tetraalkoxysilanes, isocyanatosilanes or anhydride silanes, but in particular isocyanatosilanes or anhydride silanes, are particularly preferably reacted with multi-armed polyalkoxylate precursors of the general formula (II). If all the hydroxy ends are completely reacted with the functional silanes, multi-armed silyl polyalkoxylates used according to the invention are obtained which solely bear —B—$Si(OR^1)_r(R^2)_{3-r}$ residues at the end of the arms, i.e. n=0. In such a case, group B for example consists solely of a bond or, if an isocyanatosilane was used as the functional silane, it for example comprises together with the terminal oxygen atom of group A a urethane group and the group of atoms which is located in the starting isocyanatosilane between the isocyanato group and the silyl group. If all the hydroxy ends are completely reacted with anhydride silanes, for example 3-(triethoxysilyl)propylsuccinic anhydride, multi-armed silyl polyalkoxylates are obtained which likewise solely bear —B—$Si(OR^1)_r(R^2)_{3-r}$ residues. In such a case, group B comprises together with the terminal oxygen atom of group A an ester group and the group of atoms which is located in the starting anhydride silane between the anhydride group and the silyl group.

If multi-armed silyl polyalkoxylates of the general formula (I) used according to the invention which bear at the end of their arms both hydroxy and —B—$Si(OR^1)_r(R^2)^{3-r}$ groups are produced, the procedure followed is preferably to react a polyalkoxylate precursor of the general formula (II) with a quantity of a functional silane which is substoichiometric relative to the entirety of the terminal hydroxy groups, i.e. as described above —B—$Si(OR^1)_r(R^2)_{3-r}$ groups are initially introduced, but not all of the terminal hydroxy groups in the multi-armed polyalkoxylate precursor are reacted. In this manner, multi-armed polyalkoxylates are obtained which bear both hydroxy and —$Si(OR^1)_r(R^2)_{3-r}$ groups. For example, in the case of a partial reaction of the hydroxy ends of a multi-armed polyether polyol with isocyanatosilanes, multi-armed polyalkoxylates are obtained which bear both terminal silyl groups and OH groups ($R^1$=OH). In a further step, the remaining or some of the remaining hydroxy groups may, as described, be modified to yield —B—$Si(OR^1)_r(R^2)_{3-r}$ residues.

The further components present in the aqueous agent according to the invention in addition to the at least one silyl polyalkoxylate should be selected in terms of their nature and the quantity used such that no undesired interactions occur with the silyl polyalkoxylate.

The agents according to the invention contain at least one surfactant which is selected from anionic, nonionic, amphoteric and cationic surfactants and mixtures thereof.

Suitable anionic surfactants are preferably $C_8$-$C_{18}$ alkylbenzene sulfonates, in particular with around 12 C atoms in the alkyl moiety, $C_8$-$C_{20}$ alkane sulfonates, $C_8$-$C_{18}$ monoalkyl sulfates, $C_8$-$C_{18}$ alkyl polyglycol ether sulfates with 2 to 6 ethylene oxide units (EO) in the ether moiety and sulfosuccinic acid mono- and di-$C_8$-$C_{18}$-alkyl esters. It is furthermore also possible to use $C_8$-$C_{18}$ α-olefin sulfonates, sulfonated $C_8$-$C_{18}$ fatty acids, in particular dodecylbenzenesulfonic acid, $C_8$-$C_{22}$ carboxylic acid amide ether sulfates, $C_8$-$C_{18}$ alkyl polyglycol ether carboxylates, $C_8$-$C_{18}$ N-acyl taurides, $C_8$-$C_{18}$ N-sarcosinates and $C_8$-$C_{18}$ alkyl isethionates or mixtures thereof. The anionic surfactants are preferably used as sodium salts, but may also be present as other alkali or alkaline earth metal salts, for example magnesium salts, and in the form of ammonium or mono-, di-, tri- or tetraalkylammonium salts, in the case of sulfonates, also in the form of their corresponding acid, for example dodecylbenzenesulfonic acid. Examples of such surfactants are sodium cocoalkyl sulfate, sodium sec.-alkanesulfonate with approx. 15 C atoms and sodium dioctylsulfosuccinate. Sodium fatty alkyl sulfates and fatty alkyl+2EO ether sulfates with 12 to 14 C atoms have proved particularly suitable.

Nonionic surfactants which may primarily be mentioned are $C_8$-$C_{18}$ alcohol polyglycol ethers, i.e. ethoxylated and/or propoxylated alcohols with 8 to 18 C atoms in the alkyl moiety and 2 to 15 ethylene oxide (EO) and/or propylene oxide (PO) units, $C_8$-$C_{18}$ carboxylic acid polyglycol esters with 2 to 15 EO, for example tallow fatty acid+6 EO esters, ethoxylated fatty acid amides with 12 to 18 C atoms in the fatty acid moiety and 2 to 8 EO, long-chain amine oxides with 14 to 20 C atoms and long-chain alkyl polyglycosides with 8 to 14 C atoms in the alkyl moiety and 1 to 3 glycoside units. Examples of such surfactants are oleyl-cetyl alcohol with 5 EO, nonylphenol with 10 EO, lauric acid diethanolamide, cocoalkyl dimethylamine oxide and cocoalkyl polyglucoside with on average 1.4 glucose units. $C_{8-18}$ fatty alcohol polyglycol ethers with in particular 2 to 8 EO, for example $C_{12}$ fatty alcohol+7-EO ether, and $C_{8-10}$ alkyl polyglucosides with 1 to 2 glycoside units are particularly preferably used.

In a preferred embodiment of the invention, the nonionic surfactant is selected from the group comprising polyalkylene oxides, in particular alkoxylated primary alcohols, the polyalkylene oxides possibly also being end group-terminated, alkoxylated fatty acid alkyl esters, amine oxides and alkylpolyglycosides and mixtures thereof.

Suitable amphoteric surfactants are for example betaines of the formula $(R^{iii})(R^{iv})(R^{v})N^{+}CH_2COO^{-}$, in which $R^{iii}$ means an alkyl residue with 8 to 25, preferably 10 to 21 carbon atoms optionally interrupted by heteroatoms or groups of heteroatoms and $R^{iv}$ and $R^{v}$ mean identical or different alkyl residues with 1 to 3 carbon atoms, in particular $C_{10}$-$C_{18}$ alkyl dimethyl carboxymethyl betaine and $C_{11}$-$C_{17}$ alkylamidopropyl dimethyl carboxymethyl betaine.

Suitable cationic surfactants are inter alia the quaternary ammonium compounds of the formula $(R^{vi})(R^{vii})(R^{viii})(R^{ix})N^{+}X^{-}$, in which $R^{vi}$ to $R^{ix}$ denote four identical or different, in particular two long-chain and two short-chain, alkyl residues and $X^{-}$ denotes an anion, in particular a halide ion, for example didecyldimethylammonium chloride, alkylbenzyldidecylammonium chloride and mixtures thereof.

In a preferred embodiment, however, the only surfactant components the agent contains are one or more anionic surfactants, preferably $C_8$-$C_{18}$ alkyl sulfates and/or $C_8$-$C_{18}$ alkyl ether sulfates, and/or one or more nonionic surfactants, preferably $C_{8-18}$ fatty alcohol polyglycol ethers with 2 to 8 EO and/or $C_{8-10}$ alkyl polyglucosides with 1 to 2 glycoside units.

In a particularly preferred embodiment of the invention, the agents according to the invention contain at least one nonionic surfactant, which is/are in particular selected from ethoxylated and/or propoxylated alcohols with 8 to 18 C atoms in the alkyl moiety and 2 to 15 ethylene oxide (EO) and/or propylene oxide (PO) units and alkyl polyglycosides with 8 to 14 C atoms in the alkyl moiety and 1 to 3 glycoside units.

The agents according to the invention preferably contain surfactants in quantities of 0.01 to 20 wt. %, in particular of 0.05 to 10 wt. %, preferably of 0.1 to 5 wt. % and particularly preferably of 0.2 to 1 wt. %, in each case relative to the total weight of the agent.

The agents according to the invention contain water and/or at least one nonaqueous solvent. Nonaqueous solvents which may preferably be considered are those solvents which are water-miscible in any desired ratio. The nonaqueous solvents include, for example, mono- or polyhydric alcohols, alkanolamines, glycol ethers and mixtures thereof. The alcohols used are in particular ethanol, isopropanol and n-propanol. Ether alcohols which may be considered are adequately water-soluble compounds with up to 10 C atoms per molecule. Examples of such ether alcohols are ethylene glycol monobutyl ether, propylene glycol monobutyl ether, diethylene glycol monobutyl ether, propylene glycol mono-tert.-butyl ether and propylene glycol monoethyl ether, among which ethylene glycol monobutyl ether and propylene glycol monobutyl ether are in turn preferred. In a preferred embodiment, however, ethanol is used as the nonaqueous solvent.

Nonaqueous solvents may be present in the agents according to the invention in quantities of 0.01 to 99.9 wt. %, in particular of 0.1 to 50 wt. %, and particularly preferably of 2 to 20 wt. %, in each case relative to the total weight of the agent.

Water is present in the agents according to the invention in quantities of 1 to 98 wt. %, in particular of 50 to 95 wt. %, and particularly preferably of 80 to 93 wt. %, in each case relative to the total weight of the agent.

In a further preferred embodiment, the agent according to the invention contains a thickener. Any viscosity regulators used in the prior art in laundry detergents and cleaning agents may in principle be considered for this purpose, such as for example organic natural thickeners (agar-agar, carrageenan, tragacanth, gum arabic, alginates, pectins, polyoses, guar flour, locust bean flour, starch, dextrins, gelatin, casein), modified organic natural substances (carboxymethylcellulose and other cellulose ethers, hydroxyethylcellulose and hydroxypropylcellulose and the like, seed flour ethers), completely synthetic organic thickeners (polyacrylic and polymethacrylic compounds, vinyl polymers, polycarboxylic acids, polyethers, polyimines, polyamides) and inorganic thickeners (polysilicic acids, clay minerals such as montmorillonites, zeolites, silicas). The polyacrylic and polymethacrylic compounds include, for example, the high molecular weight homopolymers, crosslinked with a polyalkenyl polyether, in particular an allyl ether of sucrose, pentaerythritol or propylene, of acrylic acid (INCI name according to International Dictionary of Cosmetic Ingredients of The Cosmetic, Toiletry, and Fragrance Association (CTFA): Carbomer), which are also known as carboxyvinyl polymers. Such polyacrylic acids are obtainable inter alia from 3V Sigma under the trade name Polygel®, for example Polygel® DA, and from B.F. Goodrich under the trade name Carbopol®, for example Carbopol® 940 (molecular weight approx. 4,000,000), Carbopol® 941 (molecular weight approx. 1,250,000) or Carbopol® 934 (molecular weight approx. 3,000,000). They furthermore include the following acrylic acid copolymers: (i) copolymers of two or more monomers from the group of acrylic acid, methacrylic acid and the simple esters thereof, preferably formed with $C_{1-4}$ alkanols (INCI Acrylates Copolymer), which include for instance the copolymers of methacrylic acid, butyl acrylate and methyl methacrylate (CAS name according to Chemical Abstracts Service: 22035-69-2) or of butyl acrylate and methyl methacrylate (CAS 25852-37-3) and which are obtainable for example from Rohm & Haas under the trade names Aculyn® and Acusol® and from Degussa (Goldschmidt) under the trade name Tego® Polymer, for example the anionic non-associative polymers Aculyn® 22, Aculyn® 28, Aculyn® 33 (crosslinked), Acusol® 810, Acusol® 823 and Acusol® 830 (CAS 25852-37-3); (ii) crosslinked high molecular weight acrylic acid copolymers, which include for instance the copolymers, crosslinked with an allyl ether of sucrose or of pentaerythritol, of $C_{10-30}$ alkyl acrylates with one or more monomers from the group of acrylic acid, methacrylic acid and the simple esters thereof, preferably formed with $C_{1-4}$ alkanols (INCI Acrylates/C10-C30 Alkyl Acrylate Crosspolymer) and which are obtainable for example from B.F. Goodrich under the trade name Carbopol®, for example hydrophobized Carbopol® ETD 2623 and Carbopol® 1382 (INCI Acrylates/C10-30 Alkyl Acrylate Crosspolymer) and Carbopol® AQUA 30 (formerly Carbopol® EX 473). Further thickeners are polysaccharides and heteropolysaccharides, in particular polysaccharide gums, for example gum arabic, agar, alginates, and the salts thereof, guar, guaran, tragacanth, gellan, ramsan, dextran or xanthan and the derivatives thereof, for example propoxylated guar, and mixtures thereof. Other polysaccharide thickeners, such as starches or cellulose derivatives, may be used as an alternative to, but preferably in addition to a polysaccharide gum, for example starches of the most varied origins and starch derivatives, for example hydroxyethyl starch, starch phosphate esters or starch acetates, or carboxymethylcellulose or the sodium salt thereof, methyl-, ethyl-, hydroxyethyl-, hydroxypropyl-, hydroxypropylmethyl- or hydroxyethylmethylcellulose or cellulose acetate. One particularly preferred polysaccharide thickener is the microbial anionic heteropolysaccharide xanthan gum, which is produced by *Xanthomonas campestris* and some other species under aerobic conditions, with a molecular weight of $2\text{-}15\times10^6$ and is obtainable for example from Kelco under the trade names Keltrol® and Kelzan® or also from Rhodia under the trade name Rhodopol®. Phyllosilicates may furthermore be used as thickeners. These include for example the magnesium or sodium/magnesium phyllosilicates obtainable under the trade name Laponite® from Solvay Alkali, in particular Laponite® RD or also Laponite® RDS, and magnesium silicates from Süd-Chemie, especially Optigel® SH. In a preferred embodiment, the agent according to the invention contains xanthan gum and succinoglycan gum.

If the agent according to the invention contains a thickener, the latter is generally present in quantities of 0.01 to 30 wt. %, in particular of 0.2 to 15 wt. %.

Depending on the intended application, the viscosity of the agents according to the invention may be adjusted within a wide range. Accordingly, low viscosity, virtually watery formulations may be preferred for multipurpose and bathroom cleaners, while higher viscosity, thickened formulations may be preferred for other applications, for example cleaning agents. In general, the viscosity of the agents according to the invention is in the range from 1 to 3000 mPa·s, preferably from 200 to 1500 mPa·s and particularly preferably from 400 to 900 mPa·s (Brookfield Rotovisco LV-DV II plus viscosimeter, spindle 31, 20° C., 20 rpm).

In a preferred embodiment, the agent according to the invention has a pH value of less than 9, in particular a pH value of 0 to 6, preferably of 1 to 5 and particularly preferably of 2 to 4.

In a further, particularly preferred embodiment the agent according to the invention contains at least one acid. Suitable acids are in particular organic acids such as formic acid, acetic acid, citric acid, glycolic acid, lactic acid, succinic acid, adipic acid, malic acid, tartaric acid and gluconic acid or also amidosulfonic acid. It may, however, be preferred for acetic acid not to be used as the acid. The inorganic acids hydrochloric acid, sulfuric acid, phosphoric acid and nitric acid or mixtures thereof may, however, additionally be used. Particularly preferred acids are those selected from the group comprising amidosulfonic acid, citric acid, lactic acid and formic acid. They are preferably used in quantities of 0.01 to 30 wt. %, particularly preferably of 0.2 to 15 wt. %, in each case relative to the total weight of the agent.

The agents according to the invention may furthermore contain other conventional ingredients of agents, in particular cleaning agents, for treating hard surfaces, provided that these do not interact in undesired manner with the substances used according to the invention.

Such other constituents which may be considered are, for example, film formers, antimicrobial active ingredients, builders, corrosion inhibitors, complexing agents, alkalis, preservatives, bleaching agents, enzymes as well as fragrances and dyes. Overall, the agents should preferably contain no more than 30 wt. %, preferably 0.01 to 30 wt. %, in particular 0.2 to 15 wt. % of further ingredients.

The agents according to the invention may contain film formers which may assist in improving wetting of surfaces. Any film-forming polymers used in the prior art in laundry detergents and cleaning agents may in principle be considered for this purpose. Preferably, however, the film former is selected from the group comprising polyethylene glycol, polyethylene glycol derivatives and mixtures thereof, preferably with a molecular weight of between 200 and 20,000,000, particularly preferably of between 5,000 and 200,000. The film former is advantageously used in quantities of 0.01 to 30 wt. %, in particular of 0.2 to 15 wt. %.

Agents according to the invention may furthermore contain one or more antimicrobial active ingredients, preferably in a quantity of 0.01 to 1 wt. %, in particular of 0.05 to 0.5 wt. %, particularly preferably of 0.1 to 0.3 wt. %. Suitable antimicrobial active ingredients are for example those from the groups of alcohols, aldehydes, antimicrobial acids or the salts thereof, carboxylic acid esters, acid amides, phenols, phenol derivatives, diphenyls, diphenyl alkanes, urea derivatives, oxygen or nitrogen acetals and formals, benzamidines, isothiazoles and the derivatives thereof such as isothiazolines and isothiazolinones, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butylcarbamate, iodine, iodophores and peroxides. Preferred antimicrobial active ingredients are preferably selected from the group comprising ethanol, n-propanol, i-propanol, 1,3-butanediol, phenoxyethanol, 1,2-propylene glycol, glycerol, undecenoic acid, citric acid, lactic acid, benzoic acid, salicylic acid, thymol, 2-benzyl-4-chlorophenol, 2,2'-methylene-bis(6-bromo-4-chlorophenol), 2,4,4'-trichloro-2'-hydroxy-diphenyl ether, N-(4-chlorophenyl)-N'-(3,4-dichlorophenyl)-urea, N,N'-(1,10-decanediyldi-1-pyridinyl-4-ylidene)-bis(1-octanamine) dihydrochloride, N,N'-bis(4-chlorophenyl)-3,12-diimino-2,4,11,13-tetraaza-tetradecane diimide amide, antimicrobial quaternary surface-active compounds, guanidines. Preferred antimicrobially active surface-active quaternary compounds contain an ammonium, sulfonium, phosphonium, iodonium or arsonium group. It is furthermore also possible to use antimicrobially active essential oils which simultaneously fragrance the cleaning agent. Particularly preferred antimicrobial active ingredients are, however, selected from the group comprising salicylic acid, quaternary surfactants, in particular benzalkonium chloride, peroxide compounds, in particular hydrogen peroxide, alkali metal hypochlorite and mixtures thereof.

Water-soluble and/or water-insoluble builders may be used in the agents according to the invention. Water-soluble builders are here preferred as they generally have a lesser tendency to leave insoluble residues behind on hard surfaces. Conventional builders which may be present for the purposes of the invention are low molecular weight polycarboxylic acids and the salts thereof, homopolymeric and copolymeric polycarboxylic acids and the salts thereof, citric acid and the salts thereof, carbonates, phosphates and silicates. Water-insoluble builders include zeolites, which may likewise be used, together with mixtures of the above-stated builder substances.

Suitable corrosion inhibitors are for example the following substances listed by their INCI names. Cyclohexylamine, Diammonium Phosphate, Dilithium Oxalate, Dimethylamino Methylpropanol, Dipotassium Oxalate, Dipotassium Phosphate, Disodium Phosphate, Disodium Pyrophosphate, Disodium Tetrapropenyl Succinate, Hexoxyethyl Diethylammonium, Phosphate, Nitromethane, Potassium Silicate, Sodium Aluminate, Sodium Hexametaphosphate, Sodium Metasilicate, Sodium Molybdate, Sodium Nitrite, Sodium Oxalate, Sodium Silicate, Stearamidopropyl Dimethicone, Tetrapotassium Pyrophosphate, Tetrasodium Pyrophosphate, Triisopropanolamine.

Complexing agents, which are also known as sequestrants, are ingredients which are capable of complexing and inactivating metal ions in order to prevent their disadvantageous effects on the stability or appearance, for example cloudiness, of the agents. On the one hand, it is important to complex the calcium and magnesium ions of water hardness which are incompatible with numerous ingredients. On the other hand, complexation of heavy metal ions such as iron or copper delays oxidative decomposition of the finished agent. Complexing agents additionally support the cleaning action. The following complexing agents, listed by their INCI names, are for example suitable: Aminotrimethylene, Phosphonic Acid, Beta-Alanine Diacetic Acid, Calcium Disodium EDTA, Citric Acid, Cyclodextrin, Cyclohexanediamine Tetraacetic Acid, Diammonium Citrate, Diammonium EDTA, Diethylenetriamine Pentamethylene Phosphonic Acid, Dipotassium EDTA, Disodium Azacycloheptane Diphosphonate, Disodium EDTA, Disodium Pyrophosphate, EDTA, Etidronic Acid, Galactaric Acid, Gluconic Acid, Glucuronic Acid, HEDTA, Hydroxypropyl Cyclodextrin, Methyl Cyclodextrin, Pentapotassium Triphosphate, Pentasodium Aminotrimethylene Phosphonate, Pentasodium Ethylenediamine Tetramethylene Phosphonate, Pentasodium Pentetate, Pentasodium Triphosphate, Pentetic Acid, Phytic Acid, Potassium Citrate, Potassium EDTMP, Potassium Gluconate, Potassium Polyphosphate, Potassium Trisphosphonomethylamine Oxide, Ribonic Acid, Sodium Chitosan Methylene Phosphonate, Sodium Citrate, Sodium Diethylenetriamine Pentamethylene Phosphonate, Sodium Dihydroxyethylglycinate, Sodium EDTMP, Sodium Gluceptate, Sodium Gluconate, Sodium Glycereth-1 Polyphosphate, Sodium Hexametaphosphate, Sodium Metaphosphate, Sodium Metasilicate, Sodium Phytate, Sodium Polydimethylglycinophenolsulfonate, Sodium Trimetaphosphate, TEA-EDTA, TEA-Polyphosphate, Tetrahydroxyethyl Ethylenediamine, Tetrahydroxypropyl Ethylenediamine, Tetrapotassium Etidronate, Tetrapotassium Pyrophosphate, Tetrasodium EDTA, Tetrasodium Etidronate, Tetrasodium Pyrophosphate, Tripotassium EDTA, Trisodium Dicarboxymethyl Alaninate, Trisodium EDTA, Trisodium HEDTA, Trisodium NTA and Trisodium Phosphate.

Agents according to the invention may furthermore contain alkalis. The bases used in agents according to the invention are preferably those from the group of alkali metal and alkaline earth metal hydroxides and carbonates, in particular sodium carbonate or sodium hydroxide. It is, however, also possible additionally to use ammonia and/or alkanolamines with up to 9 C atoms per molecule, preferably ethanolamines, in particular monoethanolamine.

Agents according to the invention may likewise contain preservatives. The substances stated in relation to the antimicrobial active ingredients may essentially be used for this purpose.

According to the invention, the agents may furthermore bleaching agents. Suitable bleaching agents comprise peroxides, peracids and/or perborates; hydrogen peroxide is particularly preferred. Sodium hypochlorite, on the other hand, is less suitable in cleaning agents with an acidic formulation due to the release of toxic chlorine gas vapors, but may be used in alkaline cleaning agents. Under certain circumstances, a bleaching activator may be present in addition to the bleaching agent.

The agent according to the invention may also contain enzymes, preferably proteases, lipases, amylases, hydrolases and/or cellulases. They may be added to the agent in any form established in the prior art. In the case of agents in liquid or gel form, this in particular includes solutions of the enzymes, advantageously as concentrated as possible, with a low water content and/or combined with stabilizers. Alternatively, the enzymes may be encapsulated, for example by spray drying or extruding the enzyme solution together with a preferably natural polymer or in the form of capsules, for example those in which the enzymes are enclosed as a solidified gel or in those of the core-shell type, in which an enzyme-containing core is coated with a protective layer which is impermeable to water, air and/or chemicals. Further active ingredients, for example stabilizers, emulsifiers, pigments, bleaching agents or dyes may additionally be applied in superimposed layers. Such capsules are applied in accordance with per se known methods, for example by agitated or rolling granulation or in fluidized bed processes. Advantageously, such granules are low-dusting, for example due to the application of a polymeric film former, and stable in storage thanks to the coating.

Agents containing enzymes may furthermore contain enzyme stabilizers in order to protect an enzyme present in an agents according to the invention from damage, such as for example inactivation, denaturation or disintegration, for instance due to physical influences, oxidation or proteolytic cleavage. Depending in each case on the enzyme used, suitable enzyme stabilizers are in particular: benzamidine hydrochloride, borax, boric acids, boronic acids or the salts or esters thereof, above all derivatives with aromatic groups, for instance substituted phenylboronic acids or the salts or esters thereof; peptide aldehydes (oligopeptides with a reduced C terminus), aminoalcohols such as mono-, di-, triethanol- and -propanolamine and mixtures thereof, aliphatic carboxylic acids with up to $C_{12}$, such as succinic acid, other dicarboxylic acids or salts of the stated acids; end group-terminated fatty acid amide alkoxylates; lower aliphatic alcohols and especially polyols, for example glycerol, ethylene glycol, propylene glycol or sorbitol; and reducing agents and antioxidants such as sodium sulfite and reducing sugars. Further suitable stabilizers are known from the prior art. Combinations of stabilizers are preferably used, for example the combination of polyols, boric acid and/or borax, the combination of boric acid or borate, reducing salts and succinic acid or other dicarboxylic acids or the combination of boric acid or borate with polyols or polyamino compounds and with reducing salts.

The agent according to the invention may finally contain one or more fragrances and/or one or more dyes as further ingredients. Dyes which may be used are both water-soluble and oil-soluble dyes, it being necessary on the one hand to ensure compatibility with further constituents, for example bleaching agents, and, on the other hand, that the dye used should not have a substantive action towards the surfaces, in particular towards WC ceramics, even in the event of an extended period of action. Selection of a suitable fragrance is likewise limited only by possible interactions with the other components of the cleaning agent.

The agent according to the invention is preferably a cleaning agent, in particular a cleaning agent for ceramics, particularly preferably of ceramic sanitary ware.

The agent according to the invention may be produced in a manner conventional in the art by suitably mixing the components present in the agent with one another.

The present invention accordingly also provides a method for producing an agent according to the invention, in which the individual constituents are mixed with one another.

The present invention also provides a method for treating a hard surface, in which the surface is contacted with an agent according to the invention, as described in the preceding text.

This method may be carried out as an independent treatment method for the surface, for example in order to provide it with dirt-repellent properties or one or more of the other properties brought about by the agents according to the invention in accordance with the teaching of the present invention. The surface is here contacted with an agent according to the invention.

The method according to the invention is preferably carried out in such a manner that the agent is distributed over the surface and advantageously then either rinsed off after a period of action of 1 second to 20 minutes, preferably of 1 to 10 minutes, or alternatively left to dry.

In a preferred embodiment of the method, contacting proceeds at a temperature of 5 to 50° C., in particular of 15 to 35° C.

In a particularly preferred embodiment, the method according to the invention is a cleaning method which serves for surface cleaning.

In particular, the method according to the invention serves for treating a surface of ceramics, glass, stainless steel or plastics material.

Another embodiment of the invention relates to the use of an agent according to the invention for protecting a hard surface from soiling and/or for easier detachment of renewed soiling from the surface, the soiling in particular involving fecal soiling and/or biofilms and/or protein deposits.

In a preferred embodiment of the invention, agents according to the invention serve for the improved removal of fecal soiling and/or biofilms from the surfaces of flush toilets and/or for reducing renewed soiling of such surfaces with fecal soiling and/or biofilms. To this end, the agent is advantageously distributed over the surface and either rinsed off after a period of action of preferably 1 to 10 minutes or alternatively left to dry. Once the surface has been treated in this manner, fecal soiling is easier to remove, often without the assistance of mechanical aids, such as for instance a WC brush. Any dried on cleaning agent residues may additionally be rinsed away more easily.

Another embodiment of the invention relates to the use of an agent according to the invention for providing a water-repellent finish on a hard surface and/or for shortening the drying time of a hard surface after exposure to water.

For cleaning reasons, it is on the one hand favorable for surfaces to comprise hydrophilic properties, since such surfaces can readily be wetted with conventional water-based cleaning fluids, so facilitating washing processes. On the other hand, it is also desired for the surfaces, once they have been cleaned with water or with water-based cleaning agents, to be free of the film of water again as quickly as possible, i.e. for the water to drain away as quickly and completely as possible, so that no film of water remains on the surface, such as for example in the case of a Teflon-coated cooking pan. Otherwise, when the film of water dries out, residual soiling may remain on the surface, such as for example lime deposit, which looks unattractive and may promote renewed soiling, for example also due to proteins and microorganisms. For this reason, it is highly advantageous that treating a surface with the agents according to the invention renders this surface hydrophilic. These facilitates wetting and detachment of dirt and simultaneously ensures that the surface is readily "dewetted" of a film of water, so avoiding water drops being formed and residual soiling being left behind. This property is particularly beneficial where surfaces are particularly exposed to lime and dirt and biofilm deposits, such as typically toilet bowls, washbasins, bathtubs and shower cubicles. Another advantage of this property is that water drains away faster from treated surfaces and these consequently dry more quickly. In a cleaning process, rinsing with clean water is generally required after treating the surface with cleaning product. It is desirable for the surfaces to dry quickly after this rinsing, for example because a quickly drying surface enhances the consumer's impression of cleanness.

The present invention also provides the use of an agent according to the invention for providing a bacteriostatic finish on a hard surface.

One particular advantage of the silyl polyalkoxylates of the formula (I) used according to the invention is that colonization by and the growth of microorganisms is suppressed on surfaces treated therewith, without biocides being required for this purpose. In this manner, a surface finish is obtained on which bacterial multiplication is prevented or substantially delayed. This is a distinct advantage relative to the prior art, in particular in the light of the fact that the use of biocides is regarded increasingly more critically with regard to environmental and consumer protection.

Another embodiment of the invention therefore relates to the use of a multi-armed silyl polyalkoxylate of the formula (I)

$$(H\text{-}A)_n\text{-}Z\text{-}[A\text{-}B\text{—}Si(OR^1)_r(R^2)_{3-r}]_m \quad (I)$$

in which

Z denotes an (m+n)-valent residue with at least three carbon atoms,

A means a divalent polyoxyalkylene residue, the m+n polyoxyalkylene residues attached to Z possibly being different from one another and a residue A in each case being joined to Z via an oxygen atom belonging to Z and an oxygen atom belonging to A being joined to B or hydrogen, B denotes a chemical bond or a divalent organic residue with 1 to 50 carbon atoms, $OR^1$ means a hydrolyzable group, $R^1$ and $R^2$ mutually independently mean a linear or branched alkyl group with 1 to 6 carbon atoms and r denotes an integer from 1 to 3, and m is an integer $\geqq 1$ and n denotes 0 or an integer $\geqq 1$, and m+n has a value of 3 to 100, for providing a bacteriostatic finish on a hard surface.

EXEMPLARY EMBODIMENTS

A. Synthesis Examples

1. Production of a Hexa-Armed Triethoxysilyl-Terminated Polyalkoxylate

The starting material used was polyether polyol which is a hexa-armed random poly(ethylene oxide-co-propylene oxide) with a EO/PO ratio of 80/20 and with a molecular weight of 12000 g/mol and was produced by anionic ring-opening polymerization of ethylene oxide and propylene oxide using sorbitol as initiator. Before being further reacted, the polyether polyol was heated to 80° C. for 1 h under a vacuum with stirring. A solution of polyether polyol (3 g, 0.25 mmol), triethylenediamine (9 mg, 0.081 mmol) and dibutyltin dilaurate (9 mg, 0.014 mmol) in 25 ml of anhydrous toluene was predissolved; to this end, a solution of (3-isocyanatopropyl)triethoxysilane (0.6 ml, 2.30 mmol) in 10 ml of anhydrous toluene was added dropwise. Stirring of the solution at 50° C. was continued overnight. After removal of the toluene under a vacuum, the crude product was repeatedly washed with anhydrous ether. After vacuum drying, the product, comprising in each case a triethoxylsilyl group at the free ends of the polymer arms of the stellate prepolymer, was obtained as a colorless viscous liquid. IR (film, $cm^{-1}$): 3349 (m, —CO—NH—), 2868 (s, —$CH_2$—, —$CH_3$), 1719 (s, —C═O), 1456 (m, —$CH_2$—, —$CH_3$), 1107 (s, —C—O—C—), 954 (m, —Si—O—). $^1$H-NMR (benzene $d_6$, ppm); 1.13 (d, —$CH_3$ from polymer arms), 1.21 (t, —$CH_3$ from silane end groups), 3.47 (s, —$CH_2$ from polymer arms), 3.74 (q, —$CH_2$ from silane end groups). The resultant triethoxysilyl-terminated polyalkoxylate exhibited a molecular weight of 13500.

2. Production of a Tri-Armed Triethoxysilyl-Terminated Polyalkoxylate

Voranol CP 1421 from DOW Chemicals was dried for 1 h at 80° C. under a vacuum with stirring. 317 mg (1.0 equivalent) of (3-isocyanatopropyl)-triethoxysilane were slowly added to 2.04 g (0.41 mmol) of the dried polyether polyol. The reaction mixture was stirred under protective gas at 100° C. for a further 2 days, until the NCO group vibration band on IR measurement had disappeared. The product, comprising in each case a triethoxylsilyl group at the free ends of the polymer arms of the polyether polyol, was obtained as a colorless viscous liquid.

3. Production of a Mixture Containing a Tri-Armed and an Octa-Armed Triethoxysilyl-Terminated Polyalkoxylate Voranol 4053 from DOW Chemicals was dried for 1 h at 80° C. under a vacuum with stirring. 20.9 mg (0.01%) of dibutyltin dilaurate and 30.3 g (1.0 equivalent) of (3-isocyanatopropyl)triethoxysilane were slowly added to 209 g (16.9 mmol) of the dried polyether polyol. The reaction mixture was stirred under protective gas at room temperature for a further 2 days, until the NCO band on IR measurement had disappeared. The product, comprising in each case a triethoxylsilyl group at the free ends of the polymer arms of the polyether polyol and constituting a mixture of a tri-armed and an octa-armed polyalkoxylate in a ratio of approx. 20/80, was obtained as a colorless viscous liquid.

B. Test Methods and Results 1.2. Easy-To-Clean Test with IKW [German Cosmetic, Toiletry, Perfumery and Detergent Association] Ballast Soil:

IKW ballast soil was produced in accordance with the literature, SÖFW-Journal, 1998, 124, 1029. The test surfaces were covered with ballast soil and dried overnight at room temperature. After drying, the surfaces were rinsed with running water. The quantity and distribution of the soil residues (white grease layer) remaining on the surfaces was used as the criterion for the Easy-to-Clean effect.

1.3. Easy-to-Clean Test with Shoe Polish Soil:

Shoe polish soil was produced as follows: a mixture of black shoe polish (6.5 wt. %), Mazola oil (3.5 wt. %), gravy (26 wt. %) and tap water (64 wt. %) was boiled at 100° C. for 2 min. The shoe polish soil was obtained by subsequent stirring for 20 min and cooling to room temperature. The test surfaces were immersed in the shoe polish soil for 2 min. After being removed, the test surfaces were dried for 1 min at room temperature and then rinsed with running water. The quantity and distribution of the soil residues (white grease layer) remaining on the surfaces were used as the criteria for the Easy-to-Clean effect.

1.4 Easy-to-Clean Test with Synthetic Fecal Soiling:

Synthetic fecal soiling was produced according to patent DE 103 57 232 B3. In a manner similar to the test method described therein, the fecal soiling was uniformly applied in spots (diameter 10 mm) onto the test surfaces using a metal template and dried for 15 min at room temperature. After drying, the surfaces were rinsed under uniformly running water in a laboratory rinsing unit which simulates the flushing process of a flush toilet. The time (in seconds) which elapses from the beginning of flushing until the time at which the yellow-brownish fecal soiling was completely removed from the surfaces and the quantity and distribution of the soil residues (white grease layer) remaining on the surfaces were used as the criteria for the Easy-to-Clean effect. Account was also taken of whether the surfaces quickly become dry again after the rinsing off.

1.5. Anti-Lime Test:

The test was carried out using Contrex brand mineral water which has an elevated calcium/magnesium content. The test surfaces were immersed in this water at room temperature for 24 hours. After removal, the test surfaces were dried in air for 2 hours and then immersed in distilled water for 20 min. After removal, the test surfaces were dried in air for a further 2 hours. A qualitative optical assessment was then first carried out as to the presence and quantity of lime on the surfaces. A quantitative determination of the quantity of lime deposited on the surfaces was then carried out. To this end, the deposited lime was dissolved off with dilute hydrochloric acid and the quantity of calcium and magnesium ions in the resultant aqueous solution was determined by titration (Metrohm standard method). The normalized quantity of lime ($mg/cm^2$) was used as the criterion for the anti-lime effect.

1.6. Microbiological Investigations:

1.6.1 Biorepulsive Power in Adhesion Testing:

The biorepulsive power of a substance to be tested was determined in an adhesion test for microorganisms using the organisms *Staphylococcus aureus* DSM799 and *Pseudomonas aeruginosa* DSM939. To this end, the substances to be tested were applied onto domestically relevant hard surfaces, such as for example ceramics, plastics material, stainless steel and glass. Test specimens of dimensions 18×18 mm were first washed with sterile distilled water and dried. The test specimen prepared in this manner were overlayered with a microbial suspension and incubated for one hour. The microbial suspensions were then aspirated and the test specimen washed twice. After transfer into sterile test plates, the test specimens for *S. aureus* were overlayered with nutrient agar and then incubated for 48 hours at 30° C. In the case of *P. aeruginosa*, the test specimens were shaken in buffer, then overlayered with nutrient agar plus 10% TZC and then incubated for 24 hours at 30° C. The shaking fluid was filtered through a membrane and the filter incubated on CASO agar for 24 hours at 30° C. The extent of microbial growth, from which it may be concluded whether the test specimens have been colonized with microorganisms, is stated relative to an untreated surface, the microbial load of the control specimen being set at 100%.

1.6.2. Anti-Biofilm Properties in Biofilm Testing:

In order to obtain longer term indications under realistic conditions regarding the surface activity of coatings on ceramics, coated surfaces (2×2 cm) were exposed to biofilm growth for 24 hours. The test specimens were laid in a microtiter plate consisting of 6 chambers. A microbial mixture consisting of *Dermacoccus nishinomiyaensis* DSM 20448, *Bradyrhizobium japonicum* DSM 1982 and *Xanthomonas campestris* DSM 1526, which forms a stable biofilm in an aqueous environment, was added thereto in a microbial count 106 CFU/ml. For the biofilm test, the microorganisms in the above-stated concentration were placed together with a dilute complete medium (TBY diluted 50 fold with DGHM [German Society for Hygiene & Microbiology] water) in the microtiter plate, which is used as a miniaturized biofilm test system. Duplicate determinations were carried out for each batch, i.e. two test specimens per batch were investigated. The 6-well plates were shaken for 24 h at 30° C. and 60 rpm. After the predetermined incubation times, 1 ml was taken from each batch for microbial counting, diluted in tryptone-NaCl solution and plated out onto CASO agar. The resultant plates were incubated for 24 h at 37° C., after which counting was performed. The test specimens were taken out of the microtiter chambers to dry at room temperature and then each stained with 6 ml of 0.01% Safranin O solution for 15 minutes. The stain solution was then aspirated and the test specimens rinsed in order to remove any unbound stain from the test specimens. After drying, the stained test specimens were assessed.

1.6.3. Laboratory Testing Under Realistic Conditions in WC Reactor:

In parallel to 1.6.2., the test specimens were investigated under realistic conditions in a WC reactor which operates almost automatically and the structure of which simulates the function of a toilet. This system makes it possible to investigate adhesion and biofilm formation in a test system on several different surfaces over a short and a longer period (in this case a total running time of two days). Unlike the microtiter plate system, this is a dynamic system as fresh medium (TBY/DGHM water 1:50) is continuously passed over the test specimen. Furthermore, the surfaces run dry in some phases and are then overlayered with liquid again. This alternation is very similar to the cycles in a toilet, where the ceramic surfaces are likewise alternately wetted or able to dry out. In terms of thickness and homogeneity, the biofilms produced in the reactor match those from microtiter plates. The reactor was first filled with 680 ml of medium, inoculated with the microbial mixture described in 1.6.2 and incubated overnight so that the microbial flora could become established in the system. As in a real toilet, flushing was carried out with water from a storage tank by opening a solenoid valve which was in turn controlled by a time switch. The toilet bowl bend was replicated by clamping test specimens in the interior of the reactor by means of an adapter. Approx. 600 ml of water was used per flush. On each of the first and second days after incubation, flushing was performed 15 times, each individual flush cycle lasting for 20 minutes. The first test specimens were removed in the morning on the first day when no or only a few flushes had taken place. The second removal took place during the afternoon after flushing; the reactor was filled with medium overnight without any flushing taking place. After removal from the reactor, the test specimens were dried at room temperature and then each stained with 6 ml of 0.01% Safranin 0 solution for 15 minutes. The stain solution was then aspirated and the test specimen rinsed in order to remove any unbound stain from the test specimens. After drying, the stained test specimens were scanned and evaluated with Corel Draw Paint 9. Untreated surfaces were also scanned in order to be able to subtract the background value caused by the surfaces of the substrates used from the measured value.

2. Production of Formulations with Silyl Polyalkoxylates:

2.1. Formulation A:

A mixture of the silyl polyalkoxylate from Synthesis Example 1 (4.8 wt. %), water (2.4 wt. %) and acetic acid (2.4 wt. %) in ethanol (ad 100 wt. %) was stirred at room temperature for 1 day. 1 part by weight of this mixture was then mixed with 20 parts by weight of an agent of the following composition:

| | |
|---|---|
| $C_{8-10}$ alkylpolyglycoside | 2.5 g |
| Lactic acid | 2.0 g |
| Water | ad 100 g |

2.2. Formulation B:

A formulation with the following composition was produced by mixing the components:

| | |
|---|---|
| Silyl polyalkoxylate from Synthesis Example 1 | 0.25 g |
| $C_{8-10}$ alkylpolyglycoside | 2.5 g |
| Lactic acid | 2.0 g |
| Water | ad 100 g |

2.3. Formulation C:

A formulation with the following composition was produced by mixing the components:

| | |
|---|---|
| Silyl polyalkoxylate from Synthesis Example 1 | 0.25 g |
| $C_{8-10}$ alkylpolyglycoside | 1.0 g |
| Fatty alcohol ethoxylate | 1.0 g |
| Formic acid | 5.0 g |
| Water | ad 100 g |

2.4. Formulation D1:

A mixture of the silyl polyalkoxylate from Synthesis Example 1 (2.50 wt. %), tetraethoxysilane (5.00 wt. %), water (3.75 wt. %) and acetic acid (3.75 wt. %) in ethanol (ad 100 wt. %) was stirred at room temperature for 1 day. 1 part by weight of this mixture was then mixed with 5 parts by weight of an

| | |
|---|---|
| $C_{8-10}$ alkylpolyglycoside | 1.0 g |
| Fatty alcohol ethoxylate | 1.0 g |
| Formic acid | 5.0 g |
| Water | ad 100 g |

2.5. Formulation D2:

A mixture of the silyl polyalkoxylate from Synthesis Example 1 (2.50 wt. %), tetraethoxysilane (15.00 wt. %), water (3.75 wt. %) and acetic acid (3.75 wt. %) in ethanol (ad 100 wt. %) was stirred at room temperature for 1 day. 1 part by weight of this mixture was then mixed with 5 parts by weight of an agent of the following composition.

| | |
|---|---|
| $C_{8-10}$ alkylpolyglycoside | 1.0 g |
| Fatty alcohol ethoxylate | 1.0 g |
| Formic acid | 5.0 g |
| Water | ad 100 g |

2.6. Formulation D3:

A mixture of the silyl polyalkoxylate from Synthesis Example 1 (2.50 wt. %), tetraethoxysilane (5.00 wt. %), water (3.75 wt. %) and acetic acid (3.75 wt. %) in ethanol (ad 100 wt. %) was stirred at room temperature for 1 day. 1 part by weight of this mixture was then mixed with 5 parts by weight of an agent of the following composition:

| | |
|---|---|
| $C_{8-10}$ alkylpolyglycoside | 2.5 g |
| Lactic acid | 2.0 g |
| Water | ad 100 g |

2.7. Formulation E:

A mixture of the silyl polyalkoxylate from Synthesis Example 1 (2.0 wt. %), N-(triethoxysilyipropyl)-O-polyethylene oxide urethane (4.0 wt. %), water (1.0 wt. %) and acetic acid (1.0 wt. %) in ethanol (ad 100 wt. %) was stirred at room temperature for 1 day. 1 part by weight of this mixture was then mixed with 10 parts by weight an agent of the following composition:

| | |
|---|---|
| $C_{8-10}$ alkylpolyglycoside | 1.0 g |
| Fatty alcohol ethoxylate | 1.0 g |
| Formic acid | 5.0 g |
| Water | ad 100 g |

3. Surface Treatment and Investigation of Surfaces:

3.1. Rapid Drying Effects:

Formulation A produced in 2.1 was sprayed onto a cleaned glazed tile or glass surface. After a brief period of action, the surface was rinsed with running water. In this manner, a coating was obtained which is hydrophilic (water contact angle approx. 40°) and simultaneously water dewetting (low hysteresis) Thanks to this water dewetting property, the surface is immediately dry when it is rinsed with water.

3.2. Easy-to-Clean Test with IKW Ballast Soil:

Formulation A produced in 2.1 was sprayed onto a cleaned black glazed tile or glass surface. After a brief period of action, the surface was rinsed with running water. The Easy-to-Clean test was carried out on the surfaces produced in accordance with method 1.2, an untreated glazed tile or glass surface serving as reference. Under identical conditions, it was established that the IKW ballast soil on the coating produced was completely removed, while a white greasy layer remained on the uncoated glazed tile or glass surface.

3.3. Easy-to-Clean Test with Shoe Polish Soil.

Formulation A produced in 2.1 was sprayed onto a cleaned white glazed tile or glass surface. After a brief period of action, the surface was rinsed with running water. The Easy-to-Clean test was carried out on the surfaces produced in accordance with method 1.3, an untreated glazed tile or glass surface serving as reference. Under identical conditions, it was established that the shoe polish soil on the coating produced was completely removed, while a white greasy layer remained on the uncoated glazed tile or glass surfaces.

3.4. Easy-to-Clean Test with Synthetic Fecal Soiling:

Formulations D1, D2 and E produced in 2.4, 2.5 and 2.7 respectively were uniformly applied onto cleaned glazed tile surfaces (glazed test toilet tiles from Villeroy & Boch). After acting for ten minutes, the surface was rinsed with running water. The Easy-to-Clean test was carried out on the surfaces produced in accordance with method 1.4, an untreated glazed tile serving as reference. Under identical conditions, it was established that, in comparison with the reference, the fecal soiling was removed faster and leaving behind fewer residues (white greasy layers) from the surfaces treated according to the invention. The results are shown in the following Table.

| Formulation | Speed of removal | Residues | Drying time |
|---|---|---|---|
| D1 | + | + | + |
| D2 | ++ | + | + |
| E | ++ | + | + |

++ distinctly better than reference
+ better than reference
– no difference relative to reference.

3.5. Anti-Lime Test:

A cleaned slide (26 cm×76 cm) was immersed in formulation D3 produced in 2.6. After a brief period of action, the surface was rinsed with running water. In this manner, a coating was obtained on both sides of the slide. The anti-lime test was carried out on the surfaces produced in accordance with method 1.5, an untreated slide serving as reference. Under identical conditions, it was established that virtually no lime deposits were visible on the coating produced, while a distinct white layer of lime remains on uncoated surfaces. A further quantitative determination by titration revealed an approx. 90% reduction in lime deposition thanks to the use of the formulation according to the invention.

3.6. Microbiological Investigations:

3.6.1. Biorepulsive Power in Adhesion Testing:

It was first tested whether the silyl polyalkoxylates used according to the invention and their formulations exhibit a biocidal action. To this end, a mixture of the silyl polyalkoxylate from Synthesis Example 1 (5.0 wt. %), water (2.5 wt. %), acetic acid (2.5 wt. %) and ethanol (ad 100%) was used as a test sample for the microbiological investigations described in 1.6.1. An identical mixture without silyl polyalkoxylate served as reference. The results showed that bacterial growth was identical for both test samples, i.e. in the concentration range of approx. 0.1 to approx. 5% the silyl polyalkoxylates have no effect on the growth of *S. aureus* and *P. aeruginosa*.

A bacterial adhesion test was furthermore carried out in accordance with method 1.6.1. on surfaces which had been treated with the agents according to the invention. To this end, a mixture of the silyl polyalkoxylate from Synthesis Example 1 (4.8 wt. %), water (2.4 wt. %), acetic acid (2.4 wt. %) in ethanol (ad 100 wt. %) was stirred at room temperature for 1 day. It was then diluted with a surfactant-containing agent (consisting of: $C_{8-10}$ alkylpoly-glycoside 2.5 g, lactic acid 2.0 g, water ad 100 g) until a final concentration of the silyl polyalkoxylate of 0.3 wt. % was obtained (formulation F1). Another formulation (formulation F2) was produced in a similar manner, but with tetraethoxysilane (in twice the quantity of the silyl polyalkoxylate on a weight basis) also being present. Glass cover slips (20 mm×20 mm) were immersed in the respective formulation for 1 min and then rinsed with running water. An untreated glass cover slip served as reference. The results revealed that both of the formulations according to the invention brought about a comparatively major reduction, which was distinct in comparison with the reference, in adhesion to glass by the two test microbes used (*Staphylococcus aureus* and *Pseudomonas aeruginosa*). This is a purely biorepulsive effect as no biocidal action could be detected. The best microbial repellency was exhibited by the formulations according to the invention against the water-borne microbe *P. aeruginosa* which is of relevance in WC and bath hygiene, a greater than 50% reduction in microbes being detected relative to the control.

3.6.2. Anti-Biofilm Properties in Biofilm Testing:

The tests were carried out in accordance with method 1.6.2. Formulation F1, which has already been described in 3.6.1, was used. The glazed ceramic tiles (25 mm×25 mm) were cleaned with ethanol and then dried. From a distance of approx. 15 cm, formulation F1 was sprayed onto the cleaned glazed tiles, allowed to act for 15 minutes and then rinsed off with water. The procedure was repeated after 15 minutes such that glazed tiles which had been sprayed 4, 5 and 7 times were produced. The controls were in each case glazed tiles which were only sprayed with the surfactant-containing agent (consisting of: $C_{8-10}$ alkylpolyglycoside 2.5 g, lactic acid 2.0 g, water ad 100 g). The glazed tiles were then dried for two hours at 60° C., after which they were used for the test. The glazed tiles treated with formulation F1 exhibited a distinct, visible reduction in biofilm in comparison with the control, the effect being the most pronounced on the glazed tiles which had been sprayed 7 times. According to culture analyses, these effects were not due to a biocidal action.

3.6.3. Laboratory Testing Under Realistic Conditions in WC Reactor:

The tests were carried out in accordance with method 1.6.3. To this end, the glazed tiles (25 mm×25 mm) were sprayed as described in 3.6.2. with the formulation F1 used therein, 6 spray strokes in each case being used for each glazed tile. The controls were in each case glazed tiles which were sprayed only with the surfactant-containing agent which is likewise described in 3.6.2. It was found after increasing flushing steps that a significant reduction in adhesion by microorganisms to the ceramics could be achieved by the treatment according to the invention. Even after two days' vigorous rinsing, the glazed tiles provided with a finish according to the invention exhibited a greater than 50% reduction in biofilm formation in comparison with the control.

3.7. Comparison of Surfaces Treated According to the Invention or According To the Prior Art with Regard to Easy-to-Clean Properties:

In cleaning applications, hydrophobic, in particular superhydrophobic, surfaces are frequently used to achieve Easy-to-Clean properties. One typical example is hydrophobic, rainwater-repellent formulations for motor vehicle windshields. In this example, a hydrophobic surface with a water contact angle of approx. 100°, produced from perfluorosilane, was compared in terms of its Easy-to-Clean effects with a surface treated according to the invention. To this end, two formulations were first produced: a mixture of the silyl polyalkoxylate from Synthesis Example 1 (0.50 wt. %), water (0.25 wt. %), acetic acid (0.25 wt. %) and ethanol (ad 100 wt. %) was stirred at room temperature for 2 days (formulation G). Another mixture, consisting of 1H,1H,2H,2H-perfluorooctyltriethoxysilane (10 wt. %), water (7.0 wt. %), acetic acid (7.0 wt. %) and ethanol (ad 100 wt. %) was stirred at room temperature for 1 day (formulation V). The hydrophilic surface coated according to the invention was produced by immersing a slide in formulation G followed by rinsing with running water. The perfluorosilane coatings were produced by dipcoating (draw speed 50 mm/min.) formulation V onto slides followed by rinsing with ethanol and running water. The untreated slide served as reference. The comparisons were made as described in 1.3 (shoe polish test) or by comparing the runoff behavior of ink (ink test). To this end, the surface in question was immersed in black ink and then slowly drawn out. The wettability or the liquid-repellent properties of the surfaces were assessed. While the ink ran off well from the surfaces treated with formulations G or V, the surface treated according to the invention completely lacking any traces of ink and, in contrast, some isolated drops of ink remaining on the surface treated with formulation V, the reference surface was almost completely covered with ink. In the shoe polish test, soil residues remained on the reference surface and on the surface treated with formulation V, while the surface treated according to the invention was completely free of soil. This example shows that the treatment according to the invention not only makes surfaces water-repellent, but can simultaneously also effectively prevent the deposition of greasy dirt onto surfaces.

3.8. Stability Testing of the Formulation Produced:

The formulation produced in 2.1 was examined in terms of its appearance (turbidity, precipitates etc.) and its ability to produce the hydrophilic and water-repellent surfaces according to the invention under real conditions (room temperature and normal atmospheric humidity). The test was carried out with a time interval of one month. To this end, the formulation was applied as described above onto glazed tile and glass surfaces and the surfaces obtained were assessed with regard to their wetting/dewetting with water. The results revealed that, within the test period (approx. 1 year), the formulation did not change in terms of appearance or activity, which would indicate that it is stable under the stated conditions.

3.9. Stability Testing:

Formulation A produced in 2.1 was sprayed onto a cleaned glazed tile or glass surface. After a brief period of action, the surface was rinsed with running water. In this manner, a coating was obtained which is hydrophilic (water contact angle approx. 40°) and simultaneously water dewetting (low hysteresis). The treated glazed tile or glass surface was stored under normal conditions (room temperature and normal atmospheric humidity) and assessed at one month intervals with regard to their wetting/dewetting with water. The results revealed that no change could be found with regard to water wettability and water runoff behavior on the surface within the test period (approx. 8 months), which would indicate that the coating is stable under the stated conditions.

3.10. Results for Different Silyl Polyalkoxylates:

Both in the IKW ballast soil test (see 1.2.) and in the shoe polish soil test (see 1.3.), similar results were achieved with the silyl polyalkoxylates from Synthesis Examples 2 and 3 as were achieved with the silyl polyalkoxylate from Synthesis Example 1. All of these substances proved to be distinctly to very distinctly superior to the reference in these tests.

The invention claimed is:

1. An agent for at least one of cleaning or providing a dirt-repellent treatment of a hard surface, the agent comprising a) a multi-armed silyl polyalkoxylate of the formula (I)

$$(H\text{-}A)_n\text{-}Z\text{-}[A\text{-}B\text{-}Si(OR^1)_r(R^2)_{3-r}]_m \quad (I)$$

wherein

Z denotes an (m+n)-valent residue comprising at least three carbon atoms, A denotes a divalent polyoxyalkylene residue, the m+n polyoxyalkylene residues attached to Z optionally differ from one another, and the A residue is joined to Z via an oxygen atom belonging to Z, and an oxygen atom belonging to A is joined to B or hydrogen; B denotes a chemical bond or a divalent organic residue having 1 to 50 carbon atoms; $OR^1$ denotes a hydrolyzable group; $R^1$ and $R^2$ independently denote a linear or branched alkyl group having 1 to 6 carbon atoms; r denotes an integer from 1 to 3; and m denotes an integer >1; and n denotes 0 or an integer ≧1, wherein m+n has a value of 3 to 100;

b) a surfactant;

c) a solvent selected from the group consisting of water and nonaqueous solvents; and d) optionally, further ingredients conventionally found in surface treatment agents that are compatible with constituents a)-d).

2. The agent of claim 1, wherein, in the formula (I), Z denotes a trivalent to octavalent acyclic or cyclic hydrocarbon residue comprising 3 to 12 carbon atoms.

3. The agent of claim 1, wherein, in the formula (I), n denotes 0, 1 or 2, and m denotes an integer from 3 to 8.

4. The agent of claim 1, wherein, in the formula (I), A denotes $—(CHR^3{-}CHR^4{-}O)_p—$, $R^3$ and $R^4$ independently denote hydrogen, methyl or ethyl, and p denotes an integer from 2 to 10,000.

5. The agent of claim 1, wherein, in the formula (I), B denotes a bond or the residue $—C(O)—NH—(CH_2)_3—$.

6. The agent of claim 1, comprising a hydrolyzable silicic acid derivative.

7. The agent of claim 6, wherein the hydrolyzable silicic acid derivative comprises a tetraalkoxysilane.

8. The agent of claim 1, wherein the surfactant is selected from the group consisting of nonionic surfactants.

9. The agent of claim 1, wherein the nonaqueous solvent is selected from the group consisting of mono- or polyhydric alcohols, alkanolamines, glycol ethers, and mixtures thereof.

10. A method for producing the agent of claim 1, wherein the individual constituents are mixed together.

11. A method for treating a hard surface, the method comprising contacting the surface with the agent of claim 1.

12. The method of claim 11, wherein the hard surface is selected from the group consisting of ceramics, glass, stainless steel and plastic material.

13. A method for protecting a hard surface from soiling, the method comprising contacting the surface with the agent of claim 1.

14. A method to facilitate detachment of soiling from a hard surface, the method comprising contacting the surface with the agent of claim 1.

15. A method for shortening the drying time of a hard surface after exposure to water, the method comprising contacting the surface with the agent of claim 1.

16. A method for providing a water-repellent finish on a hard surface, the method comprising contacting the surface with the agent of claim 1.

17. A method for providing a bacteriostatic finish on a hard surface, comprising contacting the hard surface with an agent comprising a multi-armed silyl polyalkoxylate of the formula (I)

$$(H\text{-}A)_n\text{-}Z\text{-}[A\text{-}B\text{-}Si(OR^1)_r(R^2)_{3-r}]_m \quad (I)$$

wherein Z denotes an (m+n)-valent residue with at least three carbon atoms, A denotes a divalent polyoxyalkylene residue, the m+n polyoxyalkylene residues attached to Z optionally differ from one another, and the A residue is joined to Z via an oxygen atom belonging to Z, and an oxygen atom belonging to A is joined to B or hydrogen, B denotes a chemical bond or a divalent organic residue comprising 1 to 50 carbon atoms, $OR^1$ denotes a hydrolyzable group, $R^1$ and $R^2$ independently denote a linear or branched alkyl group comprising 1 to 6 carbon atoms, r denotes an integer from 1 to 3, m denotes an integer $\geqq 1$, n denotes 0 or an integer $\geqq 1$, and m+n has a value of 3 to 100.

18. An agent for at least one of cleaning or providing a dirt-repellent treatment of a hard surface, the agent comprising a) a multi-armed silyl polyalkoxylate of the formula (I)

$$(H\text{-}A)_n\text{-}Z\text{-}[A\text{-}B\text{-}Si(OR^1)_r(R^2)_{3-r}]_m \quad (I)$$

wherein

Z denotes a trivalent to octavalent acyclic or cyclic hydrocarbon residue comprising 3 to 12 carbon atoms; A denotes $—(CHR^3{-}CHR^4{-}O)_p—$, wherein $R^3$ and $R^4$ independently denote hydrogen, methyl or ethyl, and p denotes an integer from 2 to 10,000; the m+n polyoxyalkylene residues attached to Z optionally differ from one another, and the A residue is joined to Z via an oxygen atom belonging to Z, and an oxygen atom belonging to A is joined to B or hydrogen; B denotes a bond or the residue $—C(O)—NH—(CH_2)_3—$; $OR^1$ denotes a hydrolyzable group comprising tetraalkoxysilane; $R^1$ and $R^2$ independently denote a linear or branched alkyl group comprising 1 to 6 carbon atoms; r denotes an integer from 1 to 3; m denotes an integer from 3 to 8, n denotes 0, 1 or 2; and m+n has a value of 3 to 100;

b) a nonionic surfactant;

c) a solvent selected from the group consisting of water, mono- or polyhydric alcohols, alkanolamines, glycol ethers, and mixtures thereof; and d) optionally, further ingredients conventionally found in surface treatment agents that are compatible with constituents a)-d).

* * * * *